United States Patent [19]

Baker

[11] Patent Number: 4,672,515

[45] Date of Patent: Jun. 9, 1987

[54] UTILITY LIGHT ADJUSTING AND SECURING DEVICE

[76] Inventor: John M. Baker, 8133 E. Bloomington Freeway #313, Bloomington, Minn. 55431

[21] Appl. No.: 729,527

[22] Filed: May 1, 1985

[51] Int. Cl.[4] ..... F21L 15/18

[52] U.S. Cl. ..... 362/398; 362/226; 362/430; 24/20 LS; 248/206.5

[58] Field of Search ..... 362/398, 226, 382, 269, 362/273, 282, 430; 248/298, 299, 206.5; 24/274 R, 275, 278, 20 LS, 514, 569

[56] References Cited

U.S. PATENT DOCUMENTS

| | | | |
|---|---|---|---|
| 1,932,143 | 10/1933 | Piercy | 362/398 |
| 2,380,793 | 7/1945 | Rugg | 248/298 |
| 2,442,340 | 6/1948 | Buchanan et al. | 248/298 |
| 2,506,400 | 5/1950 | Wietz | 248/206.5 |
| 2,711,872 | 6/1955 | Lampke | 248/299 |
| 2,813,710 | 11/1957 | Angle | 248/206.5 |
| 2,930,564 | 3/1960 | Maier | 248/298 |
| 3,177,358 | 4/1965 | Suttie | 362/296 |
| 4,019,047 | 4/1977 | Frey | 248/206.5 |
| 4,422,137 | 12/1983 | Watts | 248/206.5 |
| 4,470,106 | 9/1984 | Norton | 362/398 |

*Primary Examiner*—Craig R. Feinberg
*Assistant Examiner*—David A. Okonsky
*Attorney, Agent, or Firm*—Robert W. Doyle

[57] ABSTRACT

The present invention consists of a device that provides for easy adjustment of the direction of illumination produced by a utility light through a multiplicity of orientations from one attachment position. The device herein uses a metal track attached to the utility light, which track passes through a clamp and wherein the clamp can be releasably attached to various points along the track. Thus, by movement of the clamp along the track, the direction of illumination produced by the utility light can be adjusted. In addition, the device herein includes a magnet connected to the clamp for mounting of the utility light on suitable ferrous-metal support objects. Engagement and disengagement of the clamp from the track is accomplished by rotating the magnet.

3 Claims, 6 Drawing Figures

UTILITY LIGHT ADJUSTING AND SECURING DEVICE

BACKGROUND

1. Field of the Invention.

The present invention relates generally to utility lights, and in particular to adjusting and securing devices for utility lights.

2. Background of the Invention.

Utility lights, also variously known in the art as "extension lights," "work lights," or "trouble lights" generally consist of a handle having a light socket, a switch to operate the light, and a long extension cord attached to the handle, and a protection means for the light bulb.

Utility lights are typically used for temporary illumination of a work area where the available light is inadequate or non-existent. In most work situations, it is extremely inconvenient for an individual user to be required to hold the light, as both hands are generally needed for the particular work activity. Therefore, most prior art utility lights include a hook, generally consisting of rigid wire attached to the bulb protection means, so the light can be hung from a suitable support object adjacent to the work area. However, as the bulb protection means of most standard utility lights consist of a curved sheet metal shade encompassing approximately one-half of the bulb with the other one-half protected by a wire cage, the light produced by the bulb is directed in a particular orientation away from the shield, thereby, requiring accurate positioning of the light for maximal illumination of the work area. Thus, as most hooks are loosely engaged with the particular support object, a slight movement of the extension cord or the object to which the light is attached can deflect the direction of the illumination from the desired orientation, necessitating time consuming and bothersome readjustment.

In addition, hook attachment presents a limitation as to the range of area that can be adequately illuminated from any one hanging position, as a utility light can only direct the brightest beam of light in a single plane perpendicular to the axis of rotation of the hook. Thus, if a change in the orientation of the light from that plane of maximal illumination is desired, due to a small change in the position of the work area, detachment and repositioning of the light may be necessary.

Furthermore, as the hook is attached to one end of the utility light, and, as the hook is generally loosely engaged with the support object, the utility light will have a tendency to swing to a vertical or "handle down" position, due to the force of gravity. Thus, maintenance of light orientation in a plane different from the position the utility light will naturally assume requires either the potentially dangerous practice, due to the heat of the light bulb, of laying the utility light on the support object, or the use of a makeshift means for positioning the light, which approach can be inadequate or time consuming.

Various utility lights described in the prior art are directed towards improving the means by which the light can be securely attached to a support object, and to provide the means for easy adjustment of the direction of illumination over a wide range of orientations, see generally U.S. Pat. Nos. 4,321,660 to Sokol, and 4,288,848 to Fido. However, the Sokol patent teaches a mechanically complex method for utility light adjustment.

Furthermore, both the Sokol and Fido patent show specialized adjustment means that must be incorporated into the design of the light itself, and thus do not teach adjustment means that could be adaptable to the design of the majority of standard utility lights that have been produced, or as they are currently being manufactured.

SUMMARY OF THE INVENTION

The present invention consists of a novel utility light and, in particular, a novel means for securing and adjusting utility lights.

The present invention includes a standard utility light, well known in the art, which utility light consists essentially of an electrically non-conductive handle, having a socket for a light bulb, a switch to operate the light, and an electrical extension cord attached thereto, and a protection means for the light bulb, which protection means generally consists of a curved sheet metal shade covering approximately one-half of the bulb, with the other one-half protected by a wire cage.

In addition, the invention herein includes a securing and adjusting device attached to the bulb shield, that allows for easy releasable attachment of the utility light to various support objects, and for adjusting of the direction of illumination produced by the light over a wide range of orientations without requiring removal from, and reattachment to another position on the support object.

The adjusting and securing device consists of a metal track having each end of the track fastened to the bulb shade, so that the track follows the circumference of the shade. The track passes through a clamp means, which clamp means can be releasably attached to any position along the track. In the preferred embodiment of the present invention, the clamp is a four-sided, rectangular metal box in which a hole has been drilled and tapped to to accept a bolt. The clamp then operates by tightening of the bolt onto the track, which track runs through box. Thus, the adjusting and securing device herein, through use of the track and clamp means, as described, permits adjustment of the direction of maximal illumination, through approximately 180 degrees of arc, through a rotation of the utility light that follows along the circumferential shape of the protective shade. Furthermore, as the bolt is fixedly attached to a releasable securing means, the bolt can be easily rotated by turning the larger securing means, thus affording the mechanical advantage needed to tighten the bolt to the track. In addition, the position of the utility light can also be adjusted around the axis of rotation of the bolt. Thus, the combination of rotation about the axis of the bolt and the rotational movement following the circumference of the bulb shade, allows the maximal illumination produced by the utility light to be oriented in a wide variety of directions from one position on a support object. This wide range of adjustability and ease of re-orientation also allows the user to easily and quickly make subtle changes in the direction of illumination away from his or her eyes, thus preventing eye strain, and allowing a better view of the work area.

In the preferred form of the present invention, the releasable securing means is a magnet. A magnet provides for quick, secure, releasable attachment to a support object as in many work situations, the support object contains ferrous metal such as, for example, a steel beam, or automotive sheet metal. Furthermore, such magnetic securement is substantially less affected by the force of gravity than a hook securing means, thereby allowing stable attachment of the utility light in a greater number of positions than is possible with a hook means.

A standard hook, as previously described, is also included in the utility light herein, when such mode of attachment to a support object is desired.

A major advantage of the novel adjusting and securing device described herein, is that such device can be easily adapted to, i.e. retrofitted to a wide variety of utility lights, provided suitable areas for attachment of the metal track exist, thereby making the improved adjustment properties described herein available to such standard utility lights. Furthermore, such adaptation is easily and economically done as the adjusting and securing device herein is mechanically simple, and inexpensive to manufacture.

The securing and attaching device of the present invention is also contemplated for use with various objects other than utility lights which objects may require such positioning and attachment as afforded by the adjusting and securing device herein. Such positionable objects could include, for example, a flashlight, a mirror, or a camera.

Therefore, it is an object of the present invention to provide for a novel utility light and specifically to provide for a novel adjusting and securing device for utility lights.

It is further an object of the present invention to provide a means for easy and secure adjusting of the direction of illumination produced by a utility light.

It is further an object of the present invention to provide for a means of secure releasable attachment to a support object.

It is further an object of the present invention to provide for a securing and adjusting device that is easily adapted to a wide variety of utility lights.

It is further an object that the securing and attaching device of the present invention be adaptable to a variety of positionable objects.

It is further an object that the present invention be easy and inexpensive to manufacture and use.

These and further objects and advantages of the present invention will become more clear in light of the following detailed description of the preferred embodiment.

DETAILED DESCRIPTION OF THE PREFERRED EMBODIMENT

Figure 2:
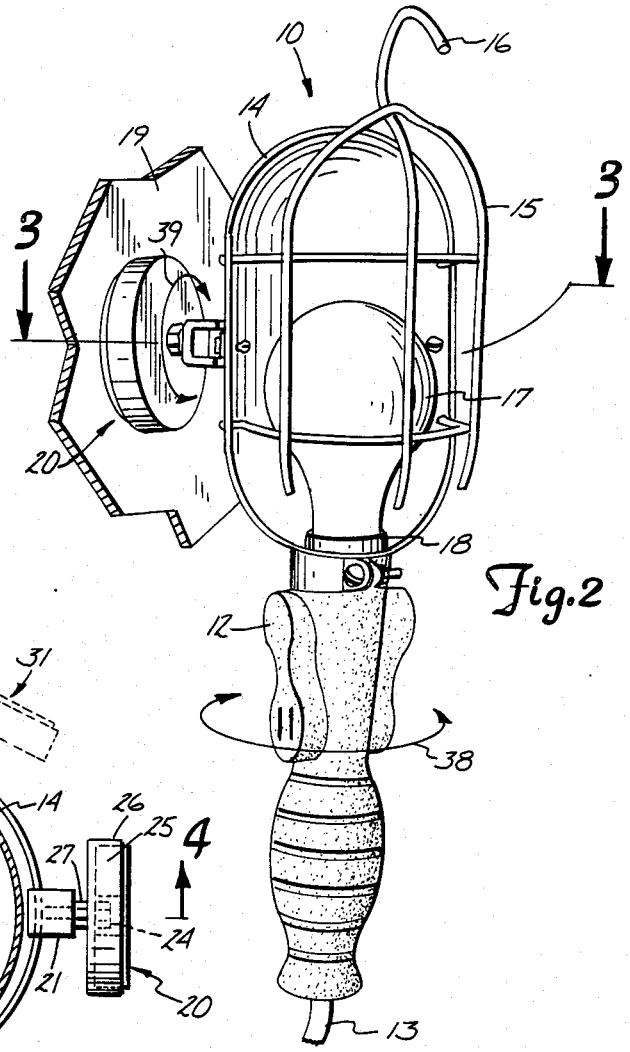
FIG. 2 is a view of the present invention as it may be attached to a support object and showing both axes of rotation.

The adjustable utility light of the present invention is seen in FIG. 2 and generally designated 10. As seen in FIG. 2, the utility light consists of handle 11, switch 12, electrical extension cord 13, protective bulb shade 14, protective bulb cage 15, hook 16, light bulb 17, and light bulb socket 18.

Figure 4:
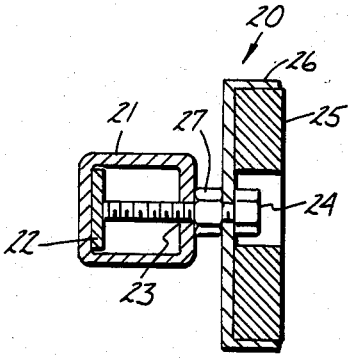
FIG. 4 is a cross-sectional view of the clamp means and the releasable securing means along the plane of sectional line 4—4, seen in FIG. 3.

As seen in FIG. 4, the adjusting and securing means generally designated 20, consists in part of rectangular metal box 21, wherein box 21 has a hole 23 threaded to accept bolt 24. Also, as seen in FIG. 4, securing means 20 includes track 22 which consists of a thin, flat metal track, which track passes through box 21. Securing means 20, as seen in FIG. 4, also consists of magnet 25 and magnet housing 26. Also, as seen in FIG. 4, bolt 24 passes through housing 26, and is fixedly secured to housing 26 by nut 27. A hole, not shown, in housing 26 is not threaded and is of sufficient diameter to allow the shaft of bolt 24 to easily pass through.

Figure 3:
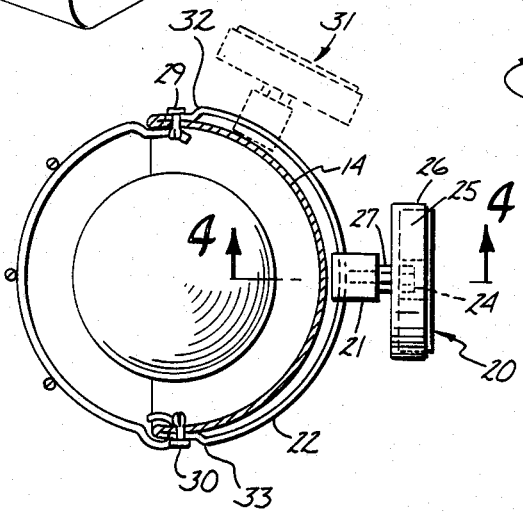
FIG. 3 is a cross-sectional view of the present invention along the plane of section line 3—3, seen in FIG. 2.
Figure 5:
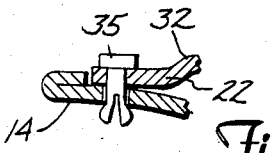
FIG. 5 is a detailed cross-sectional view of the area of attachment of the metal track to the bulb shield.
Figure 6:
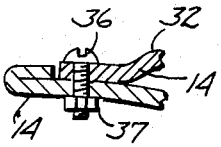
FIG. 6 is a detailed, cross-sectional view of the area of attachment of the metal track to the bulb shield, showing an alternative means of such attachment.

Metal track 22, as seen in FIG. 3 is secured to bulb shade 14 by fastening means 29, and 30. This attachment of metal track 22, as seen in FIG. 3, causes track 22 to curve approximating the circular curvature of shade 14. As seen in FIG. 5, fastening means 29 and 30 can consist of rivet 35, or as seen in FIG. 6, fastening means 29 and 30 can consist of bolt 36 and nut 37. In addition, it can be seen in FIG. 3, that track 22 is slightly crimped at points 32 and 33 to allow for greater travel of box 21 along track 22, and hence increased rotation of light 10 as the crimping permits increased space between shade 14 and track 22 near the point of attachment of track 22 to shade 14.

The operation of the present invention can now be appreciated. Referring to FIG. 4, it can be seen that bolt 24, when screwed into box 21, will apply pressure to track 22, thereby securing track 22 between bolt 24 and box 21. As bolt 24 is fixedly attached to magnet housing 26 by nut 27, as seen in FIG. 4, rotation of bolt 24 is accomplished by turning housing 26. Thus, secure fastening to track 22 is easily accomplished as the larger diameter of housing 26, in relation to bolt 24, affords the necessary mechanical advantage to tighten bolt 24 onto track 22.

Adjustment of the direction of illumination produced by utility light 10 is, by referring first to FIG. 3, seen to occur when adjusting and securing means 20 is positioned at different points along track 22, as indicated by dashed line 31. Thus, by turning housing 26, adjusting and securing means 20, can be fastened to, or loosened from track 22, and thereby slid along, and positioned at different points on track 22. By now referring to FIG. 2, a better understanding of the effect of this positioning of securing means 20, along track 22, can be seen. As seen in FIG. 2, the movement of securing means 20 along track 22, results in the rotation of light 10, about an axis around handle 11, as indicated by arc 38. This rotation results in an approximately 180 degrees of movement around the axis indicated by arc 38.

It can be appreciated by those skilled in the art that the position of light 10 can also be adjusted through rotation about the axis of bolt 24, as indicated by arc 39, as seen in FIG. 2. Such adjustment can be accomplished by detaching securing means 20 from support object 19, loosening bolt 24 from track 22, repositioning light 10 by rotating it about the axis of bolt 24 to the desired position, re-tightening bolt 24 onto track 22, and re-engaging securing means 20 to support object 19.

It can also be appreciated by those skilled in the art that the combination of both axes of rotation, represented by arcs 38 and 39, provides for a wide range of orientations of light 10 from any one position on a support object.

Figure 1:
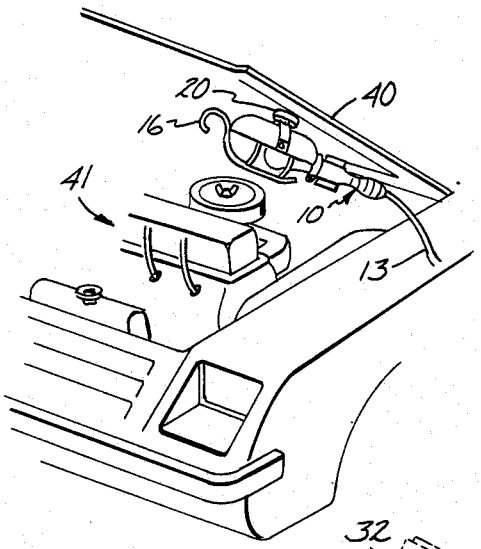
FIG. 1 shows an environmental view of the present invention as it might be used to illuminate a work area surrounding an automobile engine.

FIG. 1 shows an environmental view of the present invention as it might be used to illuminate an automobile engine. As seen in FIG. 1, securing means 20 is attached magnetically to hood 40, thus allowing for illumination by light 10 of engine compartment 41. It can also be seen in FIG. 1, that the magnetic attachment of securing means 20 to hood 41, permits the "downward" illumination of engine compartment 41, thus better enabling direction of the brightest light into engine compartment 41 than would be possible through attachment of light 10 to hood 41 using hook 16.

Certain specific structures embodying the present invention have been described herein. However, it will be apparent to persons skilled in the art that possible various modifications or rearrangments of the parts may be made without departing from the spirit and scope of the underlying inventive concept, and that the present invention is not limited to the particular forms herein shown and described except as indicated by the scope of the appended claims.

What is claimed is:

1. A securing and adjusting device comprising:

(a) track means, for connecting to a positionable object, (b) clamp means, consisting of a rectangular metal box and a bolt means, the box having a threaded hole adapted to the bolt means so that the bolt means can be screwed into the box, the box having the track means passing therethrough such that the bolt means can be tightened onto the track means, the bolt means being fixedly attached to the releasable securing means so that the bolt means can be rotated by turning the securing means and so that the orientation of the positionable object can be adjusted about the axis of rotation of the bolt means; the clamp means further having the track means passing therethrough, for releasably attaching the clamp means to the track means so that the clamp means can be attached to a plurality of points along the track means and so that the orientation of the positionable object can be adjusted, and (c) releasable securing means being fixedly attached to the clamp means so that the positionable object can be releasably attached to a support object.

2. A utility light securing and adjusting device, which comprises:

(a) track means, for connection to a utility light, (b) clamp means, consisting of a rectangular metal box and a bolt means, the box having a threaded hole adapted to the bolt means so that the bolt means can be screwed into the box, the box having the track means passing therethrough such that the bolt means can be tightened onto the track means, the bolt means being fixedly attached to the releasable securing means so that the bolt can be rotated by turning the securing means and so that the direction of the illumination emitted by the utility light can be adjusted about the axis of rotation of the bolt means; the clamp means further having the track means passing therethrough, for releasably attaching the clamp means to the track means so that the clamp means can be attached to a plurality of points along the track means and so that the direction of the illumination emitted by the utility light can be adjusted, and (c) releasable securing means being fixedly attached to the clamp means so that the utility light can be releasably attached to a support object.

3. In a portable utility light comprising an elongate power supply cord supplying power to and attached to an elongate handle, said handle having a toggleable power switch affixed therein and terminating in a fixed bulb socket, a truncate cylindrical cage having a first end fixedly attached about the bulb socket and a second end terminating in a hemispheric section with a longitudinally outwardly extending hook; the cage further having an opaque surface with longitudinal edges extending the length of the cage and approximately halfway therearound and having a plurality of guard bars disposed opposite the opaque surface; the improvement therein comprising:

(a) a flexible arcuate strip affixed near and extending between the longitudinal edges of the opaque surface, the arcuate strip further being disposed a constant distance from an outer periphery of said opaque surface;

(b) a rectangular slider disposed about the arcuate strip, and slidably movable therealong, the slider further having a threaded bolt exteding through a mating threaded hole in a first side of said slider disposed opposite the arcuate strip for selectively retainingly engaging the arcuate strip for selectively retainingly engaging the arcuate strip for selectively retainingly engaging the arcuate strip with a first end of said bolt; and (c) a circular cup shaped handle having a central hole passing therethrough disposed about a second end of the threaded bolt and a pair of nuts threadedly disposed on the threaded bolt oppositely abutting the cup shaped handle adjacent to the central hole retaining the cup shaped handle thereat; the cup shaped handle further having a disc shaped magnet affixed within said cup shaped handle; whereby, the angular movement of the cup shaped handle causes the angular movement of the threaded bolt selectively retaining the arcuate strip when turned in a first rotational direction and selectively releasing the arcuate strip in response to turning in a second rotational direction opposite said first rotational direction.

* * * * *